US005109993A

United States Patent [19]

Hutchison

[11] Patent Number: 5,109,993

[45] Date of Patent: May 5, 1992

[54] MERCHANDISE DISPLAY SYSTEM AND MERCHANDISE HOLDER THEREFOR

[76] Inventor: V. James Hutchison, 1949 S. Robb Way, Lakewood, Colo. 80228

[21] Appl. No.: 429,697

[22] Filed: Oct. 31, 1989

[51] Int. Cl.[5] ..... A47F 1/00

[52] U.S. Cl. ..... 211/87; 211/94; 211/59.1; 248/223.4

[58] Field of Search ..... 211/87, 59.1, 54.1, 211/57.1, 94; 248/221.3, 223.4, 224.2, 225.1

[56] References Cited

U.S. PATENT DOCUMENTS

| | | | |
|---|---|---|---|
| 3,297,290 | 1/1967 | Patterson | 211/59.1 X |
| 3,452,954 | 7/1969 | Lucietto et al. | 211/59.1 X |
| 3,977,109 | 8/1976 | Berry, Jr. et al. . | |
| 4,301,987 | 11/1981 | Conway | 248/307 |
| 4,362,285 | 12/1982 | Lewis | 248/221.3 |

*Primary Examiner*—Blair M. Johnson
*Attorney, Agent, or Firm*—Timothy J. Martin; Dana S. Rewoldt

[57] ABSTRACT

A merchandise holder for use with slat-wall displays and merchandise display systems incorporating the holder provided. The merchandise holder includes a base member having a front and a back, a merchandise retention member mounted on and extending forwardly of the base member and a channel engaging structure on the back of the base member. The channel engaging structure also has a biasing element to bias the base member into positive engagement with a lower retention wall that forms the lower portion of the channel. This biasing element presses against either an upper retention wall forming the slot and/or channel or an upper side wall of the channel. The channel engaging structure may be a pair of flanges that are mounted on and extend rearwardly of the base member; a lower flange engages the lower retention wall, and an upper flange engages an upper retention wall. The biasing element is preferably a pair of resilient arms that extend outwardly from the upper flange. The merchandise holder may be formed as an integral molded plastic piece so that the arms are formed of resilient plastic. Alternatively, the biasing element may be a spring clip.

20 Claims, 3 Drawing Sheets

MERCHANDISE DISPLAY SYSTEM AND MERCHANDISE HOLDER THEREFOR

FIELD OF THE INVENTION

The present invention relates to merchandise display apparatus in general and more particularly to merchandise display holders which are used in slat-wall merchandise display apparatus. Most particularly, the present invention relates to an improved merchandise display device for use with slat-wall merchandise display systems which display device will not become dislodged and fall when subject to limited upward forces while engaged in a slat-wall display channel.

BACKGROUND OF THE INVENTION

Peg board display systems have long been popular with retail merchants for displaying merchandise for selection by customers. These peg board display systems typically have a generally upright merchandise display surface made of pegboard that provides a matrix of bored holes through which prongs of hooks and other product support devices can be rearwardly passed. Product support devices are mounted in the matrix of holes at desired positions on the display surface and project forwardly of the display surface.

Recently, many retailers are replacing these pegboard merchandise display apparatus with slat-wall display systems. The slat-wall display system has an upright display surface that is provided with horizontal channels defined in part by upper and lower display surface retention walls with slot defining edges in which product support devices may be mounted. These display systems generally employ merchandise holders each with a base having a lower support member which embraces the lower edge to support the weight of the hook and merchandise and an upper locating member extending rearwardly and upwardly from a point on the base proximate to the lower support member which contacts and bears against the inside surface of the upper retention wall. This structure, shown in FIG. 1, retains the display devices and prevents the base from pitching forward. Such holders are mounted in the display surface slot by first inserting the upper locating member upwardly into the slot until the lower member is located above the lower edge and then lowering the base member until the lower locating member supportingly embraces the lower edge of the slot. Conversely, the holder may be removed from the slot by moving the base upwardly to disengage the lower support member from the lower retention wall edge and then moving the base outwardly and downwardly to withdraw the upper locator member from the channel.

These above-described slat-wall systems are generally neater in appearance than the pegboard systems and offer an advantage of continuous rather than incremental horizontal merchandise position adjustment. However, such slat-wall display apparatus of the prior art also has the disadvantage that the merchandise display holders of these systems may easily become dislodged and fall from the display surface when subject to upward forces which may occur, for example, when a customer removes merchandise from a display hook. Here, inadvertent exertion of a small upward force on the merchandise display holders, such as may occur when merchandise is removed from the holder, may lift the lower locator member from the lower retention wall edge and move it outwardly from the display surface allowing the weight of the merchandise display holder and the remaining merchandise to withdraw the upper locator member from the channel.

SUMMARY OF THE INVENTION

It is an object of the present invention to provide a merchandise holder for use with slat-wall merchandise display apparatus which resist disengagement from a channel of the display surface when subject to small upward forces such as those which may result when merchandise is removed from the merchandise holder.

A further object is to provide a merchandise holder for use with a slat-wall display device which, while resiliently resisting disengagement from a channel nonetheless are easy to install and remove from the display surface.

Yet a further object of the present invention is to provide for continuous horizontal adjustment of the merchandise holder along a slot of a slat-wall display surface while resisting dislodgment by small upward forces.

An additional objective of the present invention is to provide a slat-wall merchandise display apparatus which will provide for easy installation and removal of merchandise holders on the display surface of the display device and provide continuous horizontal adjustment of merchandise holders along the horizontal channels of the display surface but will not allow merchandise holders to become dislodged from the display display surface when merchandise is removed from the merchandise holders.

A still further object of the present invention is to provide a merchandise holder that positively and resiliently engages a slat-wall channel thereby resisting inadvertent dislodgment and horizontal displacement while maintaining a pleasing appearance.

The present invention accordingly is directed to a slat-wall merchandise display system and, in particular, to a merchandise holder for use with such a system. As is known, the slat-wall merchandise display system includes an upright support that defines a display face on a front surface thereof. One or more elongate horizontal channels are formed in the front surfaces such that each channel has an enlarged interior region and a horizontal slot opening communicating from the front surface of the upright support to the interior of the channel. The channel is thus T-shaped in cross-section so that the slot opening is formed between a pair of upper and lower retention walls which retention walls are in the form of wings that are in opposed relation to one another. Thus, the slot has a lower slot edge on the lower wing and an upper slot edge on the upper wing. The channel is thus bounded by the interior surfaces of the wings, upper and lower side support walls and a back wall.

The merchandise holder according to the present invention, then, is adapted to matably engage a horizontal slot in the upright support. To this end, a merchandise holder broadly includes a base member which has a front and back, a merchandise retention member extending forwardly of the base member and a channel engagement structure extending rearwardly of the base member. More particularly, the merchandise retention member includes a merchandise retention structure, such as a support arm, adapted for retaining merchandise thereon. The merchandise retention member has a base end attached to the base member and the merchandise retention member is oriented to extend forwardly at the front display surface when the merchandise holder is in a mounted position in the slot. The channel engagement structure is attached to the back of the base member and extends rearwardly for engaging the upper and lower retention walls in order to support the weight of the merchandise holder and the merchandise retained thereon. A biasing structure is associated with the channel engagement structure and provides means for biasing the base member away from the upper side wall of the channel and toward the lower retention wall so as to resist disengagement of the member and channel engagement structure from the slot end channel.

More specifically, the channel engagement structure includes an upper channel engagement structure and a lower channel engagement structure, preferably in the form of upper and lower extending flanges secured to the base member in fixed geometric relationship to one another. The lower channel engagement structure can be a flange which extends outwardly and downwardly from the back of the base member in order to confine the distal edge of the lower retention wall between the back of the base member and the flange. Likewise, the upper engagement structure can be an upper flange extending rearwardly and upwardly from the back of the base member in order to rest against the interior surface of the upper retention wall and to engage the upper retention wall between the flange and the back of the base member.

The biasing structure may be a spring member mounted on the upper flange. In the preferred embodiment, though, the upper flange and, indeed, the entire merchandise holder, is fabricated as a integral one piece plastic construction so that the biasing structure is defined by a pair of resilient arms extending laterally outwardly and upwardly from the upper flange to terminate respective distal ends that can bear against the upper side support wall to exert a downward force on the base member. This pair of resilient plastic arms can either be formed centrally of the distal upper flange edge or, alternatively, can be at opposite corners of the upper distal edge. The arms may terminate in rounded knobbed portioned. Where a discrete spring element is used, it may bear against either the upper side support wall or against the upper slot edge in order to exert the downward force on the base member.

Preferably, the back of the base member is substantially planar and the upper flange is formed to have a first portion that extends outwardly and away from the base member and the second portion that extends generally parallel to the back of the base member. The first portion of the upper flange can further be formed as a horizontal section normal to the back of the base member and an inclined section interconnecting the horizontal section in the second portion. Further, wherein the lower slot edge is formed at an acute angle with respect to the display surface, the lower flange of the merchandise holder may be formed at a common acute angle with respect to the back of the base member whereby the lower slot edge and the lower flange can form to one another in the mounted position.

These and other objects and features of the present invention will become more readily appreciated and understood from a consideration of the following detailed description of a preferred embodiment when considered together with the accompanying drawings, in which:

DETAILED DESCRIPTION OF THE INVENTION

Figure 1:
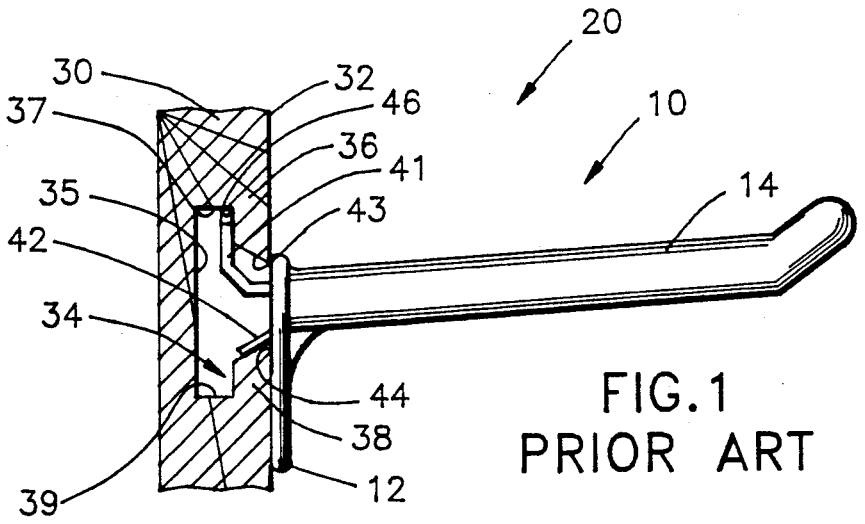
FIG.1 PRIOR ART
FIG. 1 is a sectional elevation of a slat-wall merchandise display assembly including a merchandise support hook of the prior art engaged in a channel of the slat-wall display surface.

FIG. 1 is a side view of slat-wall display merchandise support holder or hook 10 of the prior art mounted in a channel 34 of slat-wall display device 30 of slat-wall display assembly 20. Channel 34 is defined by an upper wing or retention wall 36, a lower wing or retention wall 38, upper side support surface 37, lower side support surface 39 and rear surface 35. Merchandise support hook 10 has a base 12 and hook extension 14 which extends outwardly from display surface 32 when support hook 10 is mounted in channel 34 with base 12 resting upon display surface 32. Thus, merchandise may be hung from hook extension 14 to be displayed in front of display surface 32. When merchandise support hook 10 is properly engaged in channel 34, the weight of support hook 10 and merchandise hung from hook extension 14 is supported on edge 44 of lower retention wall 38 by lower support 42. Upper locator member 41 rests against interior surface 46 of upper retention wall 36 and prevents support hook 10 from moving outward and downward under the influence of gravity acting upon support hook 10 an merchandise supported by hook extension 14.

Support hook 10 is mounted in channel 34 by first inserting upper locating member 41 upwardly into slot 45 until lower support member 42 is located above lower edge 44 and then lowering base 12 until lower support member 42 supportingly embraces lower edge 44 of the slot. Conversely, support hook 10 may be removed from slot 45 moving base 12 upward to disengage lower support member 42 from lower edge 44 and then moving base 12 outward and subsequently, downward to withdraw upper locating member 41 from channel 34. Thus, it can be seen that merchandise support hook 10 may easily be disengaged from channel 34 by any upward force exerted on hook extension 14. Such upward forces are often inadvertently imposed upon hook extension 14 by buyers when removing merchandise from hook extension 14 after making their purchase selection. Thus merchandise hook 10, together with merchandise remaining on hook extension 14, may drop from the display device 30 when merchandise is removed, resulting in merchandise breakage, disruption of the display arrangement and embarrassment of the buyer.

Figure 2A:
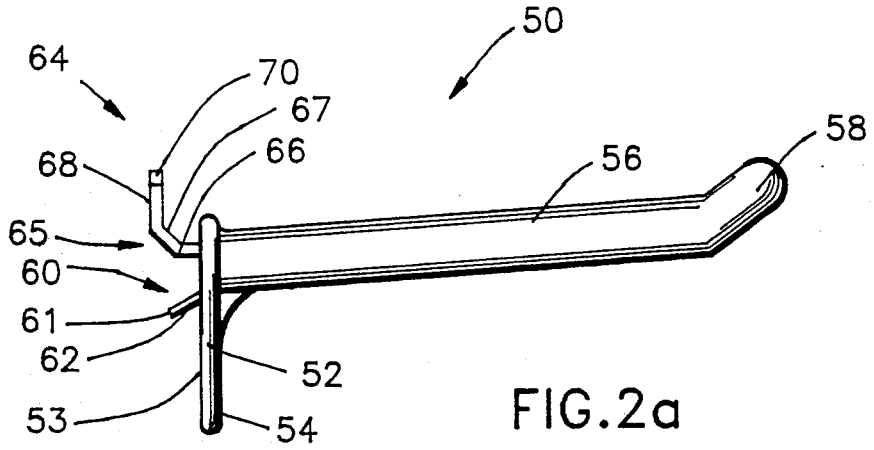
FIG. 2*a* is a side elevation of a merchandise support hook comprising an exemplary embodiment the present invention.
Figure 2B:
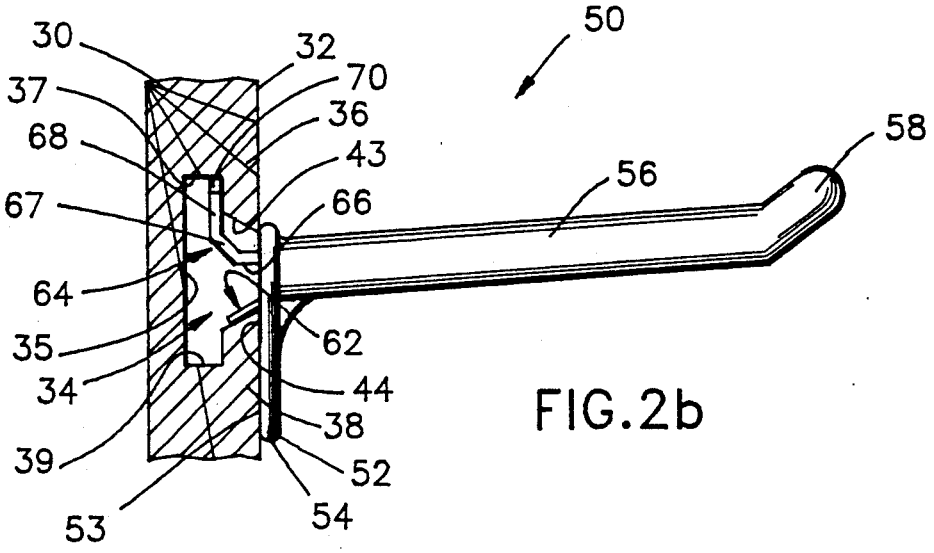
FIG. 2*b* is a sectional side elevation of a merchandise display hook comprising the present invention in the mounting channel of a display surface of a slat-wall merchandise display device.

Merchandise display holder 50 for a slat-wall merchandise display apparatus comprising a first embodiment of the present invention is shown in FIGS. 2*a* and 2*b*. Merchandise holder 50 comprises base member 52 having a back defined by rear surface 53 and a front defined by front surface 54. Merchandise retention member and merchandise retention means of the exemplary preferred embodiment of FIG. 2 comprise support arm 56 and finger portion 58. Support arm 56 is attached to front surface 54 of base member 52. While, in the exemplary preferred embodiment of FIG. 2, the merchandise retention member and retention means comprise support arm 56 with a finger portion 58, any appropriate merchandise engagement means may be utilized, for example a clamp or a series of clamps along an extension may be provided to hold the edges of bags of merchandise. Other merchandise retention means such as clips, hooks, prongs, arms, etc., are contemplated by this invention.

Horizontal flange 60 is attached to rear surface 53 at attached edge 62 and extends rearwardly and downwardly from rear surface 53 to distal edge 61 to define a lower channel engagement structure. It may further be seen that lower slot edge 44 is preferably formed at an acute angle to display surface 32. Lower flange 60 is formed at a common acute angle to base member 52 so that it conforms to edge 44. Upper channel engagement structure in the form of flange 64 extends rearwardly from surface 53 of base member 52, and includes base portion 65 attached to rear surface 53 of base member 52 at a point proximate to attached edge 62 and vertical portion 68 which extends upward to free edge 69. Base portion 65 has a horizontal section 66 and an inclined section 67 that interconnects vertical portion 68 to the back of base member 52. Upper flange 64 of the exemplary preferred embodiment further includes resilient biasing arms 70 attached to corners 69' of distal flange edge 69. Arms 70 extend upwardly and outwardly from distal edge 69 to terminate at free distal ends, as may best be seen in FIG. 3*a* which is an elevation view of the base end of exemplary merchandise holder 50 of FIG. 2*a*. It should be understood that it is within the scope of this invention for arms 70 to be attached centrally of edge 69 rather than at corners 69'. Base member 52, flange 60 and upper engagement 64 of the exemplary embodiment may be fabricated of any suitably stiff material, for example, metal or plastic. Biasing arms 70 may be made of any suitably resilient material, though, in the exemplary preferred embodiment, flange 60, retention member 56, base 52, upper engagement member 64 and biasing arms 70 are molded integrally of resilient plastic.

Referring to FIG. 2*b*, merchandise holder 50 may be installed in channel 34 of slat-wall display device 30 by first inserting upper engagement member 64 through slot 45 between upper edge 43 and lower edge 44 and then upwardly behind upper retention wall 36 until biasing arms 70 contact support surface 37, and then continuing to move merchandise holder 50 upwardly and thereby deforming biasing arms 70 as they are pressed against support surface 37. This movement is continued until the rear surface 53 of base member 52 may be brought flat against display surface 32 to position merchandise holder 50 in mounting position with flange 60 above retention wall 38 and lower edge 44.

As those familiar with the art will realize from FIG. 2*b*, the vertical distance between the point at which upper attachment member 64 is attached to rear surface 53 and the point at which edge 62 of flange 60 is attached to rear surface 53 must be smaller than the width of slot 45 by an amount at least equal to the downward draft of flange 60 to allow positioning of the support member in its mounting position. From the mounting position, base member 52 and support flange 60 are allowed to move downward in response to the biasing force of deformed biasing arms 70 until merchandise holder 50 is in its mounted position with edge 44 of lower retention wall 38 is engaged between a lower surface of support flange 60 and rear surface 53 of base member 52. Merchandise holder 50 is thus supported on edge 44 of lower retention wall 38.

Figure 4:
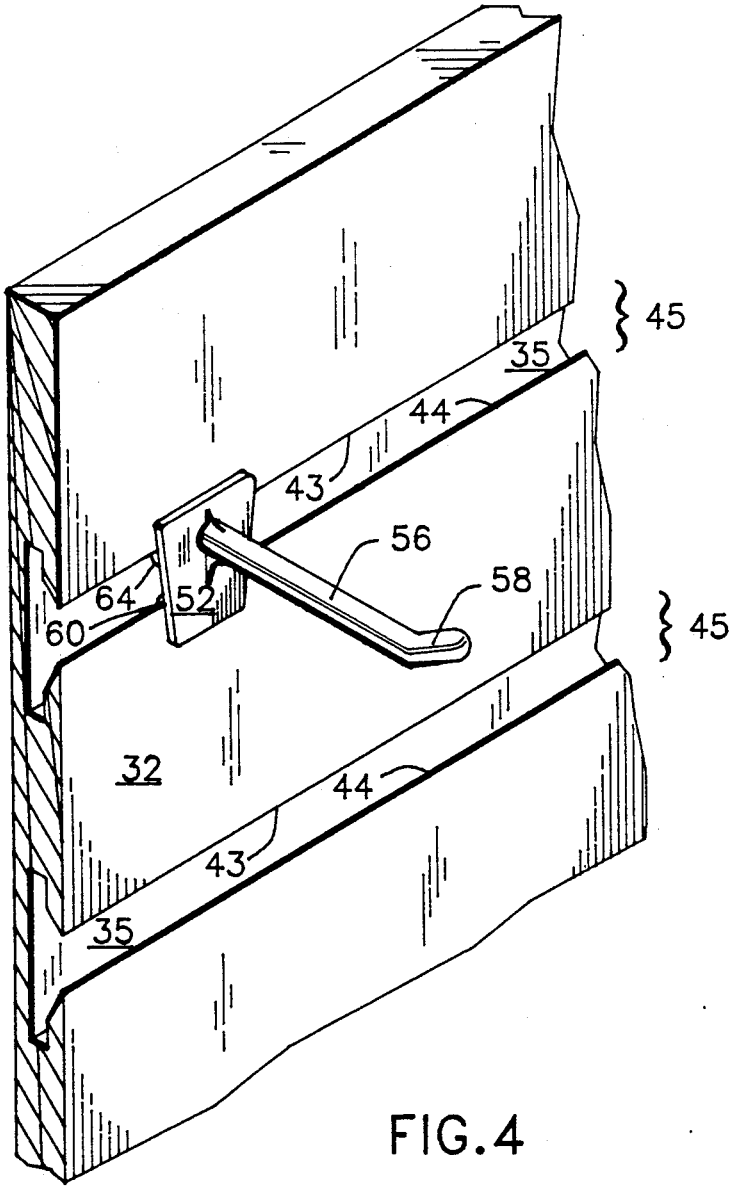
FIG. 4 is an isometric partial sectional view of a merchandise display hook comprising the present invention installed in the hook mounting channel of the display surface of a slat-walled merchandise display device.

The height of upper engagement member 64 and biasing arms 70 is such that, when retention wall 38 is engaged between support flange 60 and the back of base member 52, merchandise holder 50 is in its mounted position, as shown in FIGS. 2*b* and 4. In this mounted position, biasing arms 70 remain deformed as illustrated by the phantom lones of FIG. 3*a* and press against support surface 37 to bias support flange 60 positively against the top edge 44 of retention wall 38. This biasing force which results from the continued deformation of biasing arms 70 will then resist upward forces upon merchandise holder 50 and prevent support flange 60 from being lifted from lower retention wall 38 by moderate, inadvertent forces such as may result from handling and removal of merchandise supported by merchandise display holder 50.

While disengagement of merchandise holder 50 by moderate upward forces is resisted, merchandise holder 50 may nonetheless be easily removed from channel 34 and face 32 by exerting sufficient upward force upon base 12 to further deform biasing arms 70 and lift support flange 60 from lower retention wall 38 to move the base 52 and flange 60 outward and away from the display surface 32 to allow upper engagement member 64 to be withdrawn from channel 34.

Figure 3C:
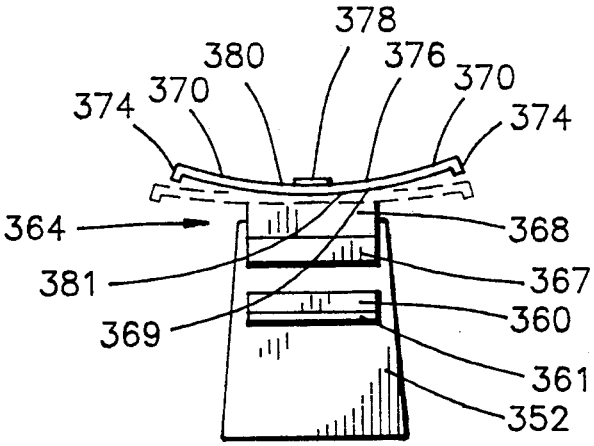
FIG. 3*c* is a base end elevation of a merchandise display hook comprising a second alternative embodiment of the present invention.
Figure 3A:
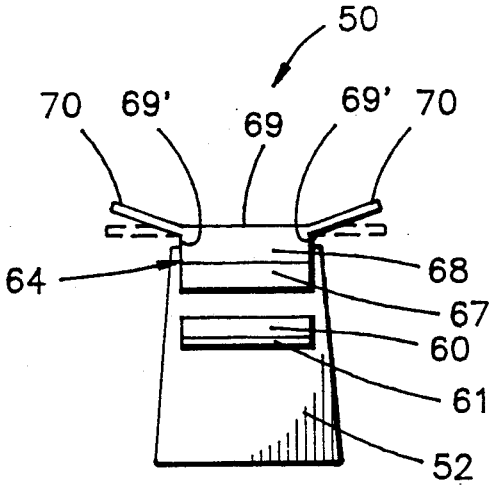
FIG. 3*a* is a base end elevation of a merchandise support hook embodying the present invention.
Figure 3B:
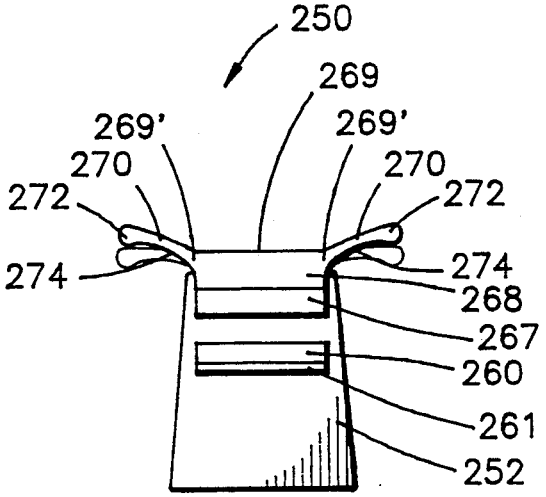
FIG. 3*b* is a base end elevation of a merchandise display hook comprising an alternative embodiment of the present invention.

Merchandise holder 250 of FIG. 3*b* comprises an alternative embodiment of the present invention. In that embodiment, biasing arms 270 are shaped with rounded full ends 272 for greater strength and increased contact surface area. Here, lower flange 260 is attached to the back of base member 252 and extends rearwardly and downwardly to terminate distal lower flange edge 261. A modified upper flange 264 includes a base portion similar to that described above, wherein the base portion has a horizontal section (not shown) and an inclined section 267. A vertical portion 268 of flange 264 extends upwardly from inclined section 267 and terminates at a distal edge 269. Arms 270 extend upwardly and laterally outwardly from corners 269' of flange 264 and terminate in rounded knobs 272. It may be seen that flange 264 has lateral side edges 274 that extend arcuately from inclined section 267 and form side edges for arms 270. Arms 270 are strengthened by this structure and a greater biasing force occurs when they are deflected, as shown in phantom, against the upper side surface 37 of channel 34.

Merchandise holder 350 of FIG. 3*c* comprises a second alternative embodiment of the present invention. Merchandise holder 350 has a base member 352. Lower flange 360 is attached to base member 352 that extends rearwardly and downwardly to terminate in lower flange edge 361. Upper flange 364 is similar to that as described with respect to flange 64 and includes a vertical portion 368 that is attached to the back of base member 352 by means of a lower portion having an inclined section 367. Upper portion 368 terminates at upper flange edge 369. A biasing member 380 includes a central portion 381 attached centrally to free edge 369 of flange 364 by rivet 378 from which resilient arms 370 extend to free ends 374. Free ends 374 are preferably shaped with curved tips to minimize friction when ends 374 are brought in contact with support surface 37. While biasing member 380 may be fabricated of any resilient material, in the embodiment of FIG. 3*c*, biasing member 380 is preferably fabricated of spring metal.

Figure 5A:
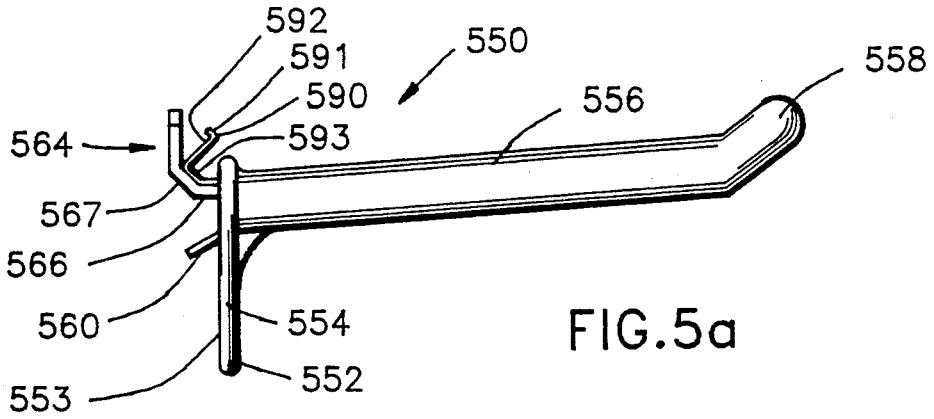
FIG. 5*a* is side elevation of yet another embodiment of a merchandise support hook according to the present invention.
Figure 5B:
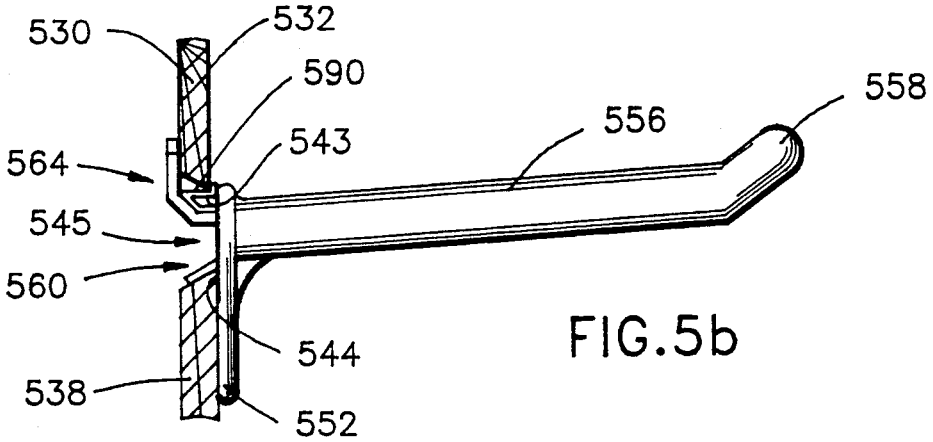
FIG. 5*b* is a sectional side elevation of the merchandise display hook of FIG. 5*a* installed in the mounting channel of a display surface of a slat-wall merchandise display device.

A third alternative embodiment comprising the present invention is shown in FIG. 5. Merchandise holder 550 is particularly useful in combination with slat-wall devices having open mounting slots 545 which have no channels lying beneath although holder 350 could be used with the channel structure described in the preferred embodiment. Merchandise holder 550 comprising the third alternative embodiment has a flat spring element 590 mounted on horizontal and incline portions 566 and 567 of upper flange 564. Biasing spring 590 is shaped with a lip 591 at its distal end defining corner 592. When merchandise holder 590 is in the mounted position, upper edge 543 of slot 545 is cradled in corner 592 resiliently bending spring 590 at corner 593 to result in a biasing force on edge 543 which maintains flange 560 lying against the top of wall 538. Spring 590 of the exemplary embodiment is preferably fabricated of spring steel, however, spring 590 may be manufactured of any suitably resilient material and may be formed intricately with base 522 and upper engagement member 564.

While exemplary merchandise display apparatus and merchandise holders embodying the present invention have been shown and described, it will be understood, of course, that the invention is not limited to these embodiments. Modifications of the present invention may be made by those skilled in the art, particularly in light of the foregoing teachings. For example, coil springs or elastic rubber foam members may be utilized to provide the biasing force and the lower channel engagement means may be shaped and extended to support the weight of the holder and merchandise on the lower support surface. It is therefore contemplated by the appended claims to cover any such modification which incorporates the the essential features of this invention or encompasses the true spirit and scope of the invention.

Accordingly, the present invention has been described with some degree of particularity directed to the preferred embodiment of the present invention. It should be appreciated though that the present invention is defined by the following claims construed in light of the prior art so that modification or changes may be made to the preferred embodiment of the present invention without departing from the inventive concepts contained therein.

I claim:

1. A merchandise holder adapted for use in a merchandise display system including a front display surface provided with a horizontal channel for said mounting merchandise support holder, the channel having an enlarged interior region bounded by a back wall, an upper side support wall and a lower side support wall each extending forwardly from said back wall, and having upper and lower retention walls extending in opposition to one another from the respective upper and lower support walls and terminating respectively in to an upper distal edge and a lower distal edge whereby a horizontal slot is formed between the upper and lower distal edges, said slot communicating from the front display surface to the interior of the channel, said merchandise holder comprising:

a base member having a front and a back;

a merchandise retention member including merchandise retention means for releasably retaining merchandise thereon, said retention member having a base end attached to the front of said base member;

channel engagement means on the back of said base member for engaging said upper and lower retention walls and supporting the weight of the merchandise holder and merchandise retained thereon; and biasing means associated with said channel engagement means for resiliently biasing said base member in a direction away from the upper retention wall and toward said lower retention wall such that disengagement of said channel engagement means from said lower retention wall by upward forces exerted upon said merchandise holder is resisted, said channel engagement means sized such that both of said upper and lower retention walls are engaged thereby when said channel engagement means is biased toward the lower retention wall.

2. A merchandise holder as in claim 1 wherein said channel engagement means includes an upper channel engagement structure and a lower channel engagement structure each extending rearwardly of said base member.

3. A merchandise holder as in claim 2 wherein said lower channel engagement structure and said merchandise retention member are secured to said base member in fixed geometric relationship to one another.

4. A merchandise holder as in claim 3 wherein said lower channel engagement structure comprises a lower flange which extends outwardly and downwardly from the back of the base member whereby a lower distal edge portion of said lower retention wall adjacent the lower distal edge may be confined to the back of said lower flange and the back of said base member.

5. A merchandise holder as in claim 4 wherein said upper engagement structure comprises an upper flange extending rearwardly and upwardly from the back of said base member to project into the interior of the channel, said upper flange adapted to rest against said upper retention wall in the interior of the channel whereby an upper distal edge portion of said upper retention wall adjacent the upper distal edge may be confined between said upper flange and said base member.

6. A merchandise holder as in claim 5 wherein said biasing means includes a spring member mounted on said upper flange.

7. A merchandise holder as in claim 5 wherein said biasing means including a pair of resilient arms extending laterally outwardly and upwardly from said upper flange to terminate in respective distal ends, each of said first and second distal ends adapted to resiliently bear against the upper support wall and thereby exert a downward force on the base member when the merchandise holder is mounted in the channel.

8. A merchandise holder as in claim 7 wherein said upper flange has a distal upper flange edge and wherein said resilient arms are attached to said upper flange centrally of upper flange edge.

9. A merchandise holder as in claim 7 wherein said upper flange has a distal upper flange edge and wherein said resilient arms are attached to said upper flange proximate opposite ends of the upper flange edge.

10. A merchandise holder as in claim 7 wherein said resilient arms and said upper flange are fabricated integrally of plastic.

11. A merchandise holder as in claim 7 wherein said first and second distal ends are each rounded to form respective knobs at the respective distal end.

12. A merchandise display system operative to support merchandise for display, comprising:

an upright support defining a display face on a front surface thereof and having an elongate channel formed horizontally in said front surface, said channel having an enlarged interior region and a horizontal slot opening communicating from the front surface of said upright support to the interior of the channel whereby an upper wing and a lower wing are formed in opposed relation to one another, said upper wing having an upper slot edge and said lower wing having a lower slot edge, said channel having a back wall, an upper side wall, a lower side wall and upper and lower front walls separated by said slot opening and respectively located on an interior side of said upper and lower wings; and a merchandise holder including a base member having a front and a back, a merchandise retention member mounted on the front of the base member and extending forwardly therefrom and including merchandise retention means for releasably retaining merchandise thereon, an upper flange mounted on the back of the base member and extending rearwardly therefrom for engaging said upper wing and a lower flange mounted on the back of the base member and extending rearwardly therefrom for engaging said lower wing, said merchandise holder adapted to be retained in a mounted position to said upright support wherein said base member abuts said upper and lower wings with said merchandise retention member extending outwardly from the display surface, wherein said upper flange extends rearwardly through said slot upwardly into the interior of the channel so that said upper wing is received between said upper flange and the back of said base member and wherein said lower flange extends rearwardly through said slot and downwardly toward the interior of the channel so that said lower wing is received between said lower flange and the back of said base member, said merchandise holder including resilient biasing means associated with said upper flange for exerting downward force on said upper flange and said base member in the mounted position whereby said lower flange is biased against said lower wing while said upper wing is retained in a received relationship between said upper flange and the back of said base member.

13. A merchandise display system as in claim 12 wherein said biasing means includes a spring element on said upper flange and operative to bear against the upper slot edge.

14. A merchandise display system as in claim 12 wherein said biasing means includes a spring element on said upper flange and operative to bear against the upper side wall of the channel.

15. A merchandise display system as in claim 14 wherein said merchandise holder is formed as an integral one-piece molded structure of plastic, said spring element defined by a pair of arms formed at an upper wing edge of said upper flange and extending to respective distal arm ends and oriented to contact and deflect against the upper side wall of the channel when said merchandise holder is in the mounted position.

16. A merchandise display system as in claim 15 wherein said arms extend from a central portion of the upper wing edge.

17. A merchandise display system as in claim 15 wherein said arms extend laterally of upper flange corners at opposite ends of the upper wing edge.

18. A merchandise display apparatus as in claim 12 wherein the back of said base member is substantially planar and wherein said upper flange includes a first portion attached to the back of said base member and extending outwardly and away from said base member, and a second portion attached to said first portion and extending generally parallel to the back of said base member.

19. A merchandise display apparatus as in claim 18 wherein said first portion includes a horizontal section normal to the back of said base member and an inclined section interconnecting said horizontal section and said second portion.

20. A merchandise display apparatus as in claim 18 wherein the lower slot edge is formed at an acute angle with respect to the display surface, said lower flange formed at a common angle with respect to the back of said base member whereby the lower slot edge and said lower flange conform to one another in the mounted position.

* * * * *